US005479735A

United States Patent [19]

Martin, Jr.

[11] Patent Number: 5,479,735

[45] Date of Patent: Jan. 2, 1996

[54] VEHICLE REMINDER SIGN

[76] Inventor: Larkland T. Martin, Jr., 1590 E. New York Ave., Apt. 7A, Brooklyn, N.Y. 11212

[21] Appl. No.: 313,773

[22] Filed: Sep. 28, 1994

[51] Int. Cl.[6] ..... G09F 21/04

[52] U.S. Cl. ..... 40/593; 40/643; 40/607; 248/74.3; 248/230.4

[58] Field of Search ..... 40/593, 316, 317, 40/661, 649, 693, 607; 248/231.8, 231, 231.5, 74.3

[56] References Cited

U.S. PATENT DOCUMENTS

| | | | |
|---|---|---|---|
| 2,383,881 | 8/1945 | Murphy | 40/607 |
| 3,131,842 | 5/1964 | Dingle, Jr. et al. | 248/311.2 |
| 3,237,330 | 3/1966 | Dinstbir | 40/593 |
| 3,958,351 | 5/1976 | Summey | 40/607 |
| 4,061,299 | 12/1977 | Kurosaki | 248/74.3 X |
| 4,677,780 | 7/1987 | Shuman | 40/649 X |
| 4,876,810 | 10/1989 | Piana et al. | 40/316 |
| 5,058,300 | 10/1991 | Earnest et al. | 40/611 X |
| 5,058,523 | 10/1991 | Mikkonen et al. | 40/593 X |
| 5,129,608 | 7/1992 | Goldman | 248/74.3 |
| 5,344,112 | 9/1994 | Peterson et al. | 248/74.3 X |
| 5,367,750 | 11/1994 | Ward | 248/74.3 X |

*Primary Examiner*—Kenneth J. Dorner
*Assistant Examiner*—James O. Hanson

[57] ABSTRACT

A reminder sign for alerting a driver to a vehicle condition, appointment, or the like. The inventive device includes a clamp securable to a vehicle lever, such as a gear shift, with a support stanchion extending from the clamp. A sign support is coupled to a distal end of the stanchion and receives any one of the plurality of signs therein. The device can be utilized to remind a driver that the vehicle lights are on to preclude unintentional draining of the battery power.

6 Claims, 4 Drawing Sheets

VEHICLE REMINDER SIGN

BACKGROUND OF THE INVENTION

1. Field of the Invention

The present invention relates to sign support structures and more particularly pertains to a vehicle reminder sign for alerting a driver to a vehicle condition or other appointment.

2. Description of the Prior Art

The use of sign support structures is known in the prior art. More specifically, sign support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art sign support structures include U.S. Pat. No. 5,124,684; U.S. Pat. No. 4,642,737; U.S. Pat. No. 4,194,175; U.S. Pat. No. 3,581,276; and U.S. Pat. No. D,328,413.

While these devices fulfill their respective, particular objectives and requirements, the aforementioned patents do not disclose a vehicle reminder sign for alerting a driver to a vehicle condition or appointment which includes a clamp securable to a vehicle lever, with a support stanchion extending from the clamp and coupled to a sign support which receives any one of a plurality of signs therein.

In these respects, the vehicle reminder sign according to the present invention substantially departs from the conventional concepts and designs of the prior art, and in so doing provides an apparatus primarily developed for the purpose of alerting a driver to a vehicle condition, appointment, or the like.

SUMMARY OF THE INVENTION

In view of the foregoing disadvantages inherent in the known types of sign support structures now present in the prior art, the present invention provides a new vehicle reminder sign construction wherein the same can be utilized for reminding a vehicle driver of a vehicle condition, appointment, or the like. As such, the general purpose of the present invention, which will be described subsequently in greater detail, is to provide a new vehicle reminder sign apparatus and method which has many of the advantages of the sign support structures mentioned heretofore and many novel features that result in a vehicle reminder sign which is not anticipated, rendered obvious, suggested, or even implied by any of the prior art sign support structures, either alone or in any combination thereof.

To attain this, the present invention generally comprises a reminder sign for alerting a driver to a vehicle condition, appointment, or the like. The inventive device includes a clamp securable to a vehicle lever, such as a gear shift, with a support stanchion extending from the clamp. A sign support is coupled to a distal end of the stanchion and receives any one of the plurality of signs therein. The device can be utilized to remind a driver that the vehicle lights are on to preclude unintentional draining of the battery power.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vehicle reminder sign apparatus and method which has many of the advantages of the sign support structures mentioned heretofore and many novel features that result in a vehicle reminder sign which is not anticipated, rendered obvious, suggested, or even implied by any of the prior art sign support structures, either alone or in any combination thereof.

It is another object of the present invention to provide a new vehicle reminder sign which may be easily and efficiently manufactured and marketed.

It is a further object of the present invention to provide a new vehicle reminder sign which is of a durable and reliable construction.

An even further object of the present invention is to provide a new vehicle reminder sign which is susceptible of a low cost of manufacture with regard to both materials and labor, and which accordingly is then susceptible of low prices of sale to the consuming public, thereby making such vehicle reminder signs economically available to the buying public.

Still yet another object of the present invention is to provide a new vehicle reminder sign which provides in the apparatuses and methods of the prior art some of the advantages thereof, while simultaneously overcoming some of the disadvantages normally associated therewith.

Still another object of the present invention is to provide a new vehicle reminder sign for alerting a vehicle driver or passenger to a vehicle condition, appointment, or the like.

Yet another object of the present invention is to provide a new vehicle reminder sign which includes a clamp securable to a vehicle lever, with a support stanchion extending from the clamp and coupled to a sign support which receives any one of a plurality of signs therein.

Even still another object of the present invention is to provide a new vehicle reminder sign which can be utilized to remind a driver that the vehicle lights are on so as to preclude unintentional draining of the battery power.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof, Such description makes reference to the annexed drawings wherein.

DESCRIPTION OF THE PREFERRED EMBODIMENT

Figure 1:
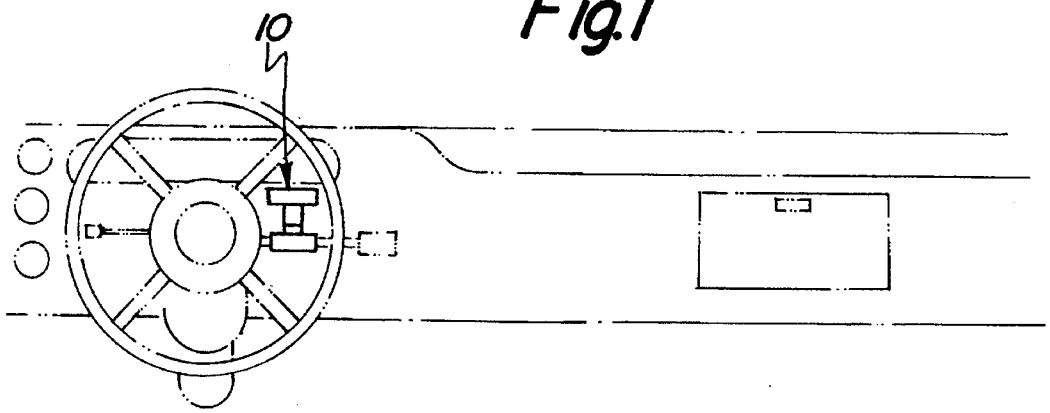
FIG. 1 is a front elevation view of a vehicle reminder sign according to the present invention and installed to a portion of a vehicle.

With reference now to the drawings, and in particular to FIGS. 1–8 thereof, a new vehicle reminder sign embodying the principles and concepts of the present invention and generally designated by the reference numeral 10 will be described.

Figure 2:
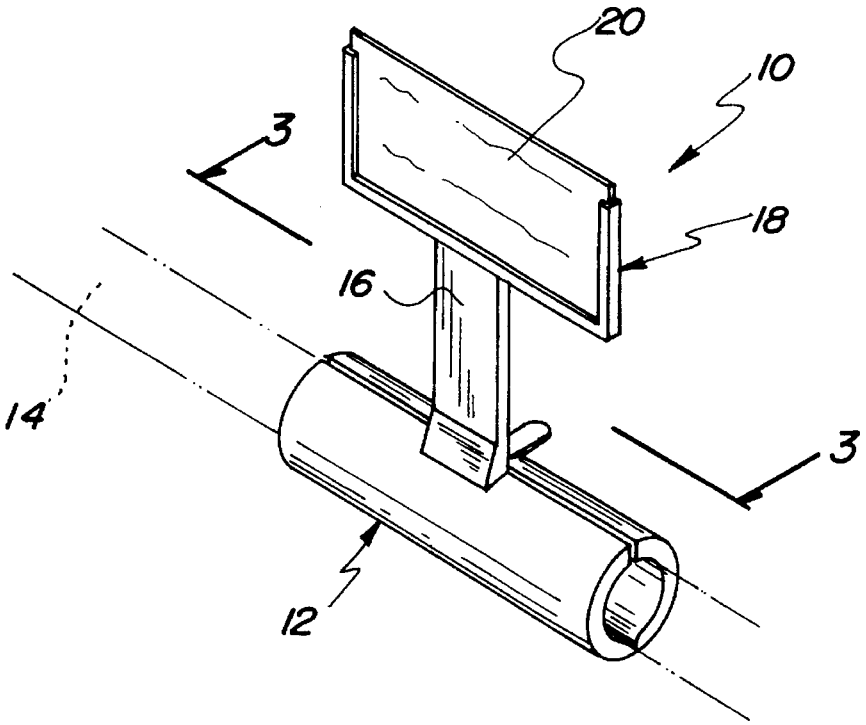
FIG. 2 is an isometric illustration of the present invention.

More specifically, it will be noted that the vehicle reminder sign 10 comprises a clamp means 12 for securing to a vehicle lever 14, such as the column gear shift lever illustrated in FIGS. 1 and 2. A support stanchion 16 extends from the clamp means 12 to mount and support a sign support means 18 at an upper distal end of the stanchion. The sign support means 18 is operable to receive and support a reminder sign 20 having a message thereon, such as the sign illustrated in FIG. 3.

Figure 5:
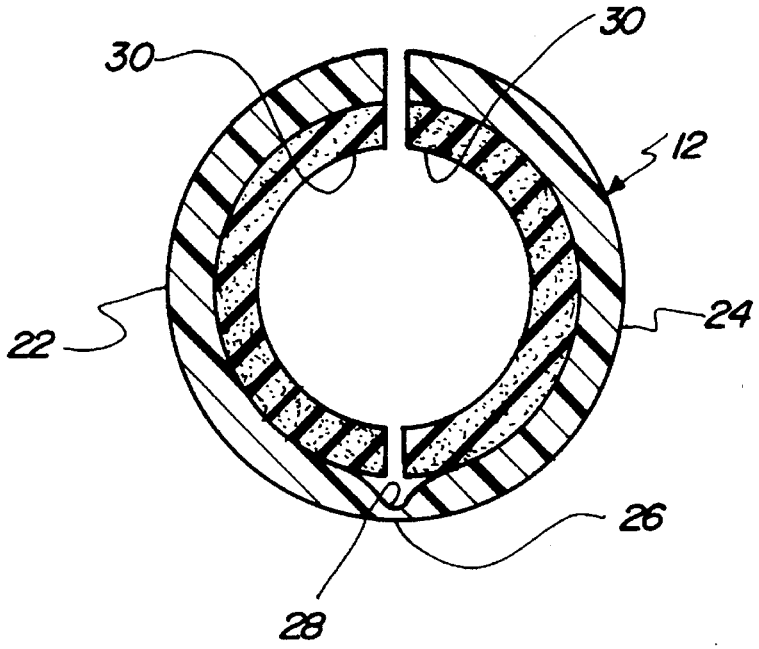
FIG. 5 is a further cross-sectional view taken along line 5—5 of FIG. 3.

As shown in FIG. 5, the clamp means 12 comprises a first semi-cylindrical member 22 pivotally coupled along a longitudinal edge thereof to a second semi-cylindrical member 24 by an integral hinge 26. The integral hinge 26 is formed by a reduced cross-sectional area 28 extending along a longitudinal length of the clamp means 12 which permits the resiliently deformable material of the cylindrical member 22 and 24 to pivot and define the integral hinge 26. By this structure, the cylindrical members 22 and 24 can be biased apart and positioned in concentric, surrounding relationship to the vehicle lever 14, as shown in FIG. 2. The clamp means 12 may further include a cushioned gripping material 30 extending along an interior surface of the cylindrical members 22 and 24 to promote frictional engagement of the clamp means 12 to the vehicle lever 14 while simultaneously precluding any damage, such as scratching or marring, of the vehicle lever.

Figure 4:
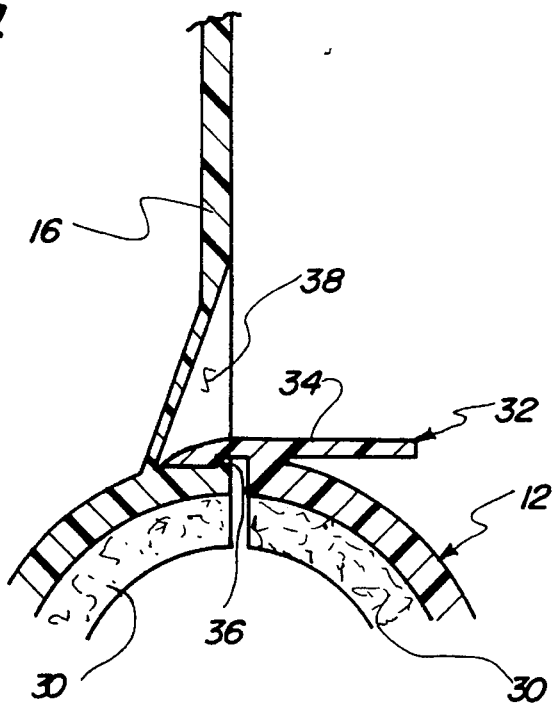
FIG. 4 is a cross-sectional view taken along line 4—4 of FIG. 3.

Referring now to FIG. 4, it can be shown that a latch means 32 is provided to removably secure the second semi-cylindrical member 24 to the first semi-cylindrical member 22 of the clamp means 12. To this end, the latch means 32 comprises a lever 34 coupled to a free end of the second semi-cylindrical member 24. The lever 34 includes an unlabelled integral detent which engages a projection 36 of the first semi-cylindrical member 22. By this structure, the second semi-cylindrical member 24 can be selectively secured to the first semi-cylindrical member 22 to position and secure the clamp means 12 about the vehicle lever 14. To conceal the latch means 32, the stanchion 16 is provided with an integral cavity 38 within which the projection 36 is located. Thus, the lever 34 is effectively hidden from view because of its positioning behind the stanchion 16.

Figure 3:
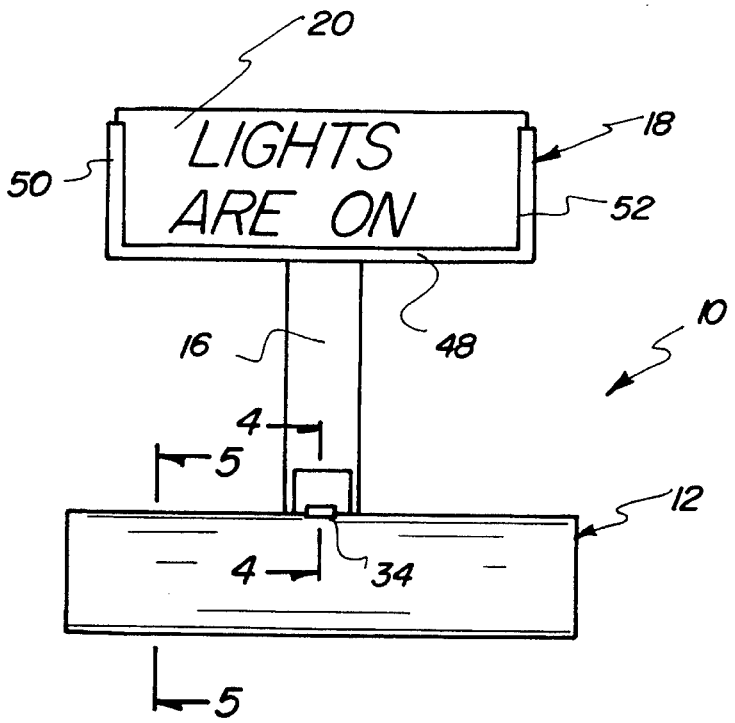
FIG. 3 is a rear elevation view of the present invention as seen from line 3—3 of FIG. 2.
Figure 6:
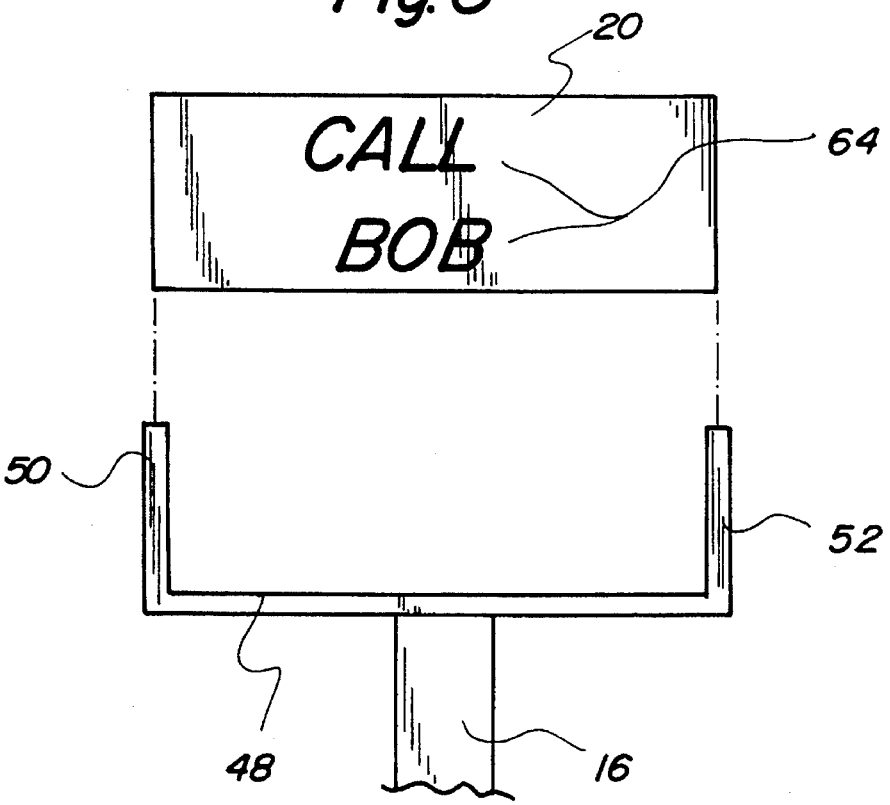
FIG. 6 is an enlarged front elevation view of a portion of the present invention.

As shown in FIGS. 3 and 6, the sign support means 18 is coupled to an upper distal end of the stanchion 16 and comprises a horizontal channel 40 having first and second opposed ends, with a first vertical channel 50 orthogonally projecting from a first end thereof and a second vertical channel 52 orthogonally projecting from a second end of the horizontal channel. The channels 48–52 are in contiguous communication and cooperate to receive and support the sign 20 therewithin. To this end, the horizontal channel 48 may be integrally molded with the vertical channels 50 and 52.

Figure 7:
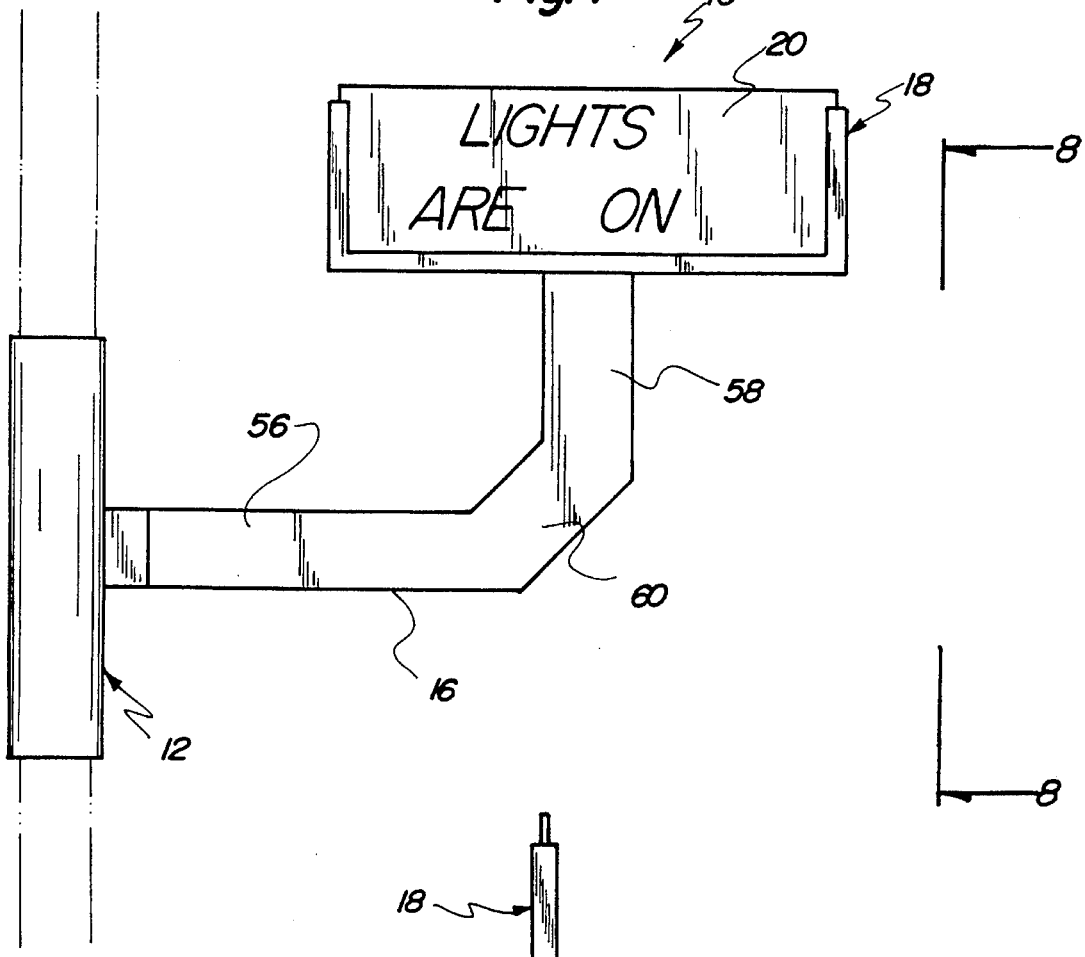
FIG. 7 is a front elevation view of a modified form of the present invention.
Figure 8:
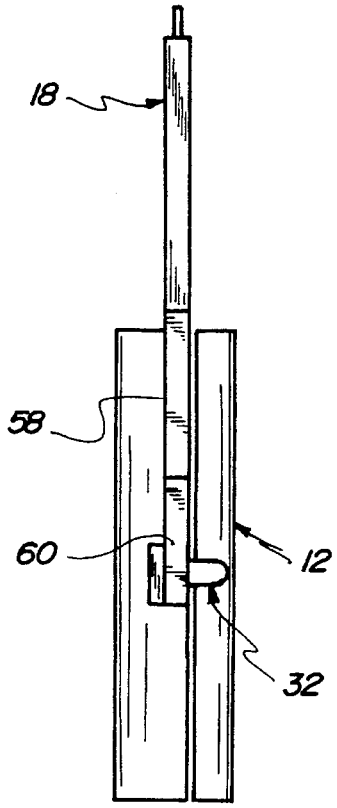
FIG. 8 is a side elevation view taken from line 8—8 of FIG. 7.

Turning now to FIGS. 7 and 8, the present invention 10 may comprise a modified stanchion 16 which permits the device to be utilized with a vehicle lever 14 extending in a vertical direction, such as a floor gear shift lever or the like. To this end, the modified stanchion 16 comprises a first horizontal stanchion portion 56 projecting from the clamp means 12 and coupled to a second vertical stanchion portion 58 by an integral bend 60. The sign support means 18 is coupled to an upper distal end of the vertical stanchion portion 58 so as to receive and support the sign 20 in the position shown in FIG. 7. In this configuration, the first horizontal stanchion portion 56 includes the integral cavity 38 for disguising the latch means 32, as shown in FIG. 8.

In use, the vehicle reminder sign 10 can be easily attached to a vehicle lever 14 within the vehicle, whereby any of a plurality of signs 20 may be inserted into the sign support means 18. The signs 20 can include various indicia 64 thereon for reminding a driver of vehicle conditions, appointments, shopping lists, or the like. The device 10 is particularly useful to remind a driver that the vehicle lights are on. To this end, the sign 20 having the "lights are on" indicia 64 can be positioned into the sign support means 18 when the vehicle lights are energized. Thus, when the driver parks the vehicle through a movement of the vehicle lever 14, the vehicle reminder sign 10 will alert the driver to the vehicle condition of the lights being on. By this method, the driver remembers to turn off the lights, thereby precluding an unintentional draining of the battery power and subsequent damage to the battery and electrical system.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vehicle reminder sign comprising:

a clamp means for circumferential surrounding and securing to a vehicle lever, said clamp means comprising a first semi-cylindrical member, a second semi-cylindrical member, and an integral hinge pivotally coupling said first semi-cylindrical member to said second semi-cylindrical member along longitudinal edges thereof, said integral hinge being formed by a reduced cross-sectional area extending along a longitudinal length of said clamp means;

a support stanchion extending from said clamp means;

at least one reminder sign; and a sign support means mounted to an upper distal end of said stanchion for receiving and supporting said reminder sign having a message thereon.

2. The vehicle reminder sign of claim 1, wherein said clamp means further comprises a cushioned gripping material extending along an interior surface of said cylindrical members to promote frictional engagement of said clamp means to said vehicle lever while simultaneously precluding damage to said vehicle lever.

3. The vehicle reminder sign of claim 2, wherein said clamp means further comprises a latch means for removably securing said second semi-cylindrical member to said first semi-cylindrical member, said latch means comprising a lever coupled to a free end of said second semi-cylindrical member, said lever including a detent; a projection extending from said first semi-cylindrical member, said detent engaging said projection to secure said clamp means about said vehicle lever.

4. The vehicle reminder sign of claim 3, wherein said sign support means comprises a horizontal channel having first and second opposed ends, with a first vertical channel orthogonally projecting from a first end thereof and a second vertical channel orthogonally projecting from a second end of the horizontal channel, said channels being in contiguous communication and cooperating to receive and support said reminder sign therewithin.

5. A vehicle reminder sign comprising:

a clamp means for securing to a vehicle lever, said clamp means comprising a first semi-cylindrical member; a second semi-cylindrical member; an integral hinge pivotally coupling said first semi-cylindrical member to said second semi-cylindrical member along longitudinal edges thereof, said integral hinge being formed by a reduced cross-sectional area extending along a longitudinal length of said clamp means; a cushioned gripping material extending along an interior surface of said cylindrical members to promote frictional engagement of said clamp means to said vehicle lever while simultaneously precluding damage to said vehicle lever; and a latch means for removably securing said second semi-cylindrical member to said first semi-cylindrical member, said latch means comprising a lever coupled to a free end of said second semi-cylindrical member, said lever including a detent; a projection extending from said first semi-cylindrical member, said detent engaging said projection to secure said clamp means about said vehicle lever;

a support stanchion extending from said clamp means;

at least one reminder sign; and, a sign support means mounted to an upper distal end of said stanchion for receiving and supporting said reminder sign having a message thereon, said sign support means comprising a horizontal channel having first and second opposed ends, with a first vertical channel orthogonally projecting from a first end thereof and a second vertical channel orthogonally projecting from a second end of the horizontal channel, said channels being in contiguous communication and cooperating to receive and support said reminder sign therewithin;

wherein said stanchion is provided with an integral cavity within which said projection is located such that said lever is hidden from view.

6. A vehicle reminder sign comprising:

a clamp means for securing to a vehicle lever, said clamp means comprising a first semi-cylindrical member; a second semi-cylindrical member; an integral hinge pivotally coupling said first semi-cylindrical member to said second semi-cylindrical member along longitudinal edges thereof, said integral hinge being formed by a reduced cross-sectional area extending along a longitudinal length of said clamp means; a cushioned gripping material extending along an interior surface of said cylindrical members to promote frictional engagement of said clamp means to said vehicle lever while simultaneously precluding damage to said vehicle lever; and a latch means for removably securing said second semi-cylindrical member to said first semi-cylindrical member, said latch means comprising a lever coupled to a free end of said second semi-cylindrical member, said lever including a detent; a projection extending from said first semi-cylindrical member, said detent engaging said projection to secure said clamp means about said vehicle lever;

a support stanchion extending from said clamp means;

at least one reminder sign; and, a sign support means mounted to an upper distal end of said stanchion for receiving and supporting said reminder sign having a message thereon, said sign support means comprising a horizontal channel having first and second opposed ends, with a first vertical channel orthogonally projecting from a first end thereof and a second vertical channel orthogonally projecting from a second end of the horizontal channel, said channels being in contiguous communication and cooperating to receive and support said reminder sign therewithin;

wherein said stanchion is provided with an integral cavity within which said projection is located such that said lever is hidden from view, said stanchion comprising a first horizontal stanchion portion projecting from said clamp means; and a second vertical stanchion portion coupled to a distal end of said first horizontal stanchion portion, with said sign support means being coupled to an upper distal end of said second vertical stanchion portion.

* * * * *